United States Patent [19]

Hagen

[11] 4,395,985

[45] Aug. 2, 1983

[54] THROTTLE VALVE CLOSURE SENSING SWITCH

[75] Inventor: William A. Hagen, St. Ann, Mo.

[73] Assignee: ACF Industries, Inc., New York, N.Y.

[21] Appl. No.: 300,132

[22] Filed: Sep. 8, 1981

[51] Int. Cl.[3] ..... F02M 3/00

[52] U.S. Cl. ..... 123/339; 123/361

[58] Field of Search ..... 123/339, 361, 352–355

[56] References Cited

U.S. PATENT DOCUMENTS 4,161,994 7/1979 Collonia ..... 123/361

4,212,272 7/1980 Hawk ..... 123/361

*Primary Examiner*—William A. Cuchlinski, Jr.

*Attorney, Agent, or Firm*—J. Joseph Muller

[57] ABSTRACT

An improvement to apparatus for adjusting the position to which a carburetor throttle valve closes. A switch 1 senses when the throttle valve moves toward its substantially closed position. The switch includes a set of electrical contacts (3A and 3B). A pin (11) engages an extendible and retractable member (M) for moving one the contacts into contact with the other when the throttle lever contacts the member as the throttle valve closes. A spring (5) biases the pin against the member to preload the member. An adjustment screw (21) adjusts the position of the electrical contacts relative to each other.

4 Claims, 3 Drawing Figures

THROTTLE VALVE CLOSURE SENSING SWITCH

BACKGROUND OF THE INVENTION

This invention relates to apparatus for idle speed control of internal combustion engines and more particularly to an adjustable throttle valve closure sensing switch incorporated in apparatus for adjusting throttle valve position to control idle speed United States patent application 108,497 filed Dec. 31, 1979, now abandoned and assigned the same assignee as the present application, discloses apparatus for adjusting the position of a throttle valve on a carburetor to control engine idle speed. One phase of operation of such apparatus is sensing throttle valve closure and supplying an indication thereof to an electronic unit which, in turn, determines the degree of throttle valve closure necessary to have the engine operate at some predetermined idle speed and commands the apparatus to limit the degree of closure so that idle speed is maintained. For this purpose, a switch is incorporated in the apparatus described in the application to detect when the throttle valve is closing and to provide an electrical indication of such closure to the electronics unit.

The present application describes an improved switch mechanism for sensing throttle valve closure. The mechanism described herein is advantageous in that it includes a preloading feature for compensating for limit stack tolerances which result during fabrication of apparatus such as that described in the aforementioned application, as well as an adjustability feature for facilitating calibration of the apparatus.

SUMMARY OF THE INVENTION

Among the several objects of the present invention may be noted the improvement to apparatus for adjusting the position to which a carburetor throttle valve closes; the provision of such an improvement for sensing throttle valve closure and supplying an electrical indication thereof; the provision of such an improvement for compensating for stacking tolerances which occur during fabrication of the apparatus; the provision of such an improvement by which the position at which throttle valve closure is sensed is adjustable thereby to permit easier calibration of the apparatus; and, the provision of such an improvement which is readily accomodated in the apparatus.

Briefly, the improvement of the present invention comprises a switch for sensing throttle valve closure on a carburetor for an internal combustion engine. The switch includes a set of electrical contacts and means engaging an extendible and retractable member of the apparatus for moving one of the contacts into contact with the other when a throttle lever contacts the member as the throttle valve closes. The engaging means is biased against the extendible and retractable member to preload it. And, means are provided for adjusting the position of the electrical contacts relative to each other. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
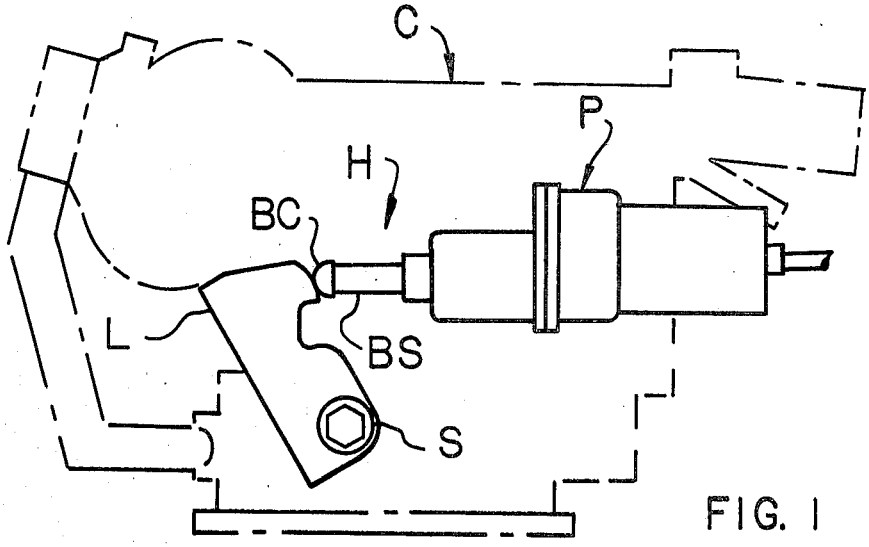
FIG. 1 is an outline view of a carburetor for an internal combustion engine with apparatus for adjusting the position to which a throttle valve of the carburetor is allowed to close.
Figure 2:
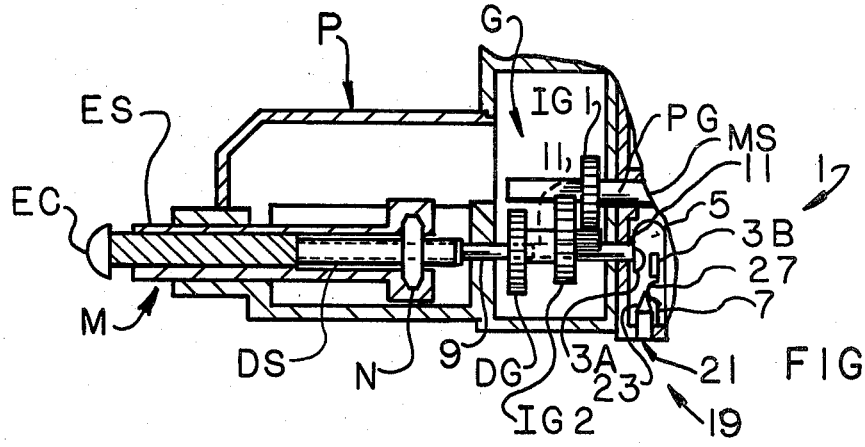
FIG. 2 is a sectional view of a portion of the apparatus of FIG. 1 illustrating the improvement of the present invention; and, FIG. 3 is a sectional view of the improvement of the present invention in more detail.

Referring to the drawings, a carburetor C for installation on an internal combustion engine (not shown) has a throttle valve (also not shown) mounted on a throttle shaft S. A throttle lever L is attached to one end of the shaft and rotational movement of this throttle lever in either direction opens and closes the throttle valve all as is well known in the art. As described in United States patent application 108,497 filed Dec. 31, 1979, and assigned to the same assignee as the present application, a throttle valve positioner P is mounted on or adjacent the carburetor and acts to adjust the position to which the throttle valve closes. Referring to FIGS. 1 and 2, positioner P includes a reversible d.c. motor (not shown) which has a rotatable shaft MS. The positioner further includes an extendible and retractable member M which has an outer end contacting throttle lever L. This member serves two functions. First, when the member is extended the outer end contacts throttle lever L and pushes it in a counterclockwise direction as shown in FIG. 1. This in turn causes rotation of the throttle valve to open it. Second, when the throttle valve is closed (a clockwise movement of throttle lever L) member M serves to limit the degree of throttle valve closure. The degree to which positioner P opens the throttle valve or permits its closure controls engine idle speed. This in turn is determined by a various engine operating parameters which are sensed and the development of a control signal supplied to positioner P the characteristics of which are based upon the sensed engine operating parameters.

As shown in FIG. 2, extendible and retractable member M comprises a rotatable drive screw DS and a nut N through which the screw is threaded. An elongate sleeve ES extends outwardly from the housing of the d.c. motor and the outer end of the sleeve extends beyond the housing in which the various components of positioner P are installed. A contactor EC having a rounded outer end is received in sleeve ES and makes physical contact with throttle lever L.

Positioner P further includes a set of gears indicated generally G for translating rotary movement of motor shaft MS, in either direction, into linear movement of member M in the appropriate direction. As shown in FIG. 2 and described in the referenced application, gears G comprises a set of four gears; a pinion gear PG, first and second intermediate gears IG1 and IG2 respectively, and a drive gear DG which serves to turn drive screw DS to extend or retract member M.

Figure 3:
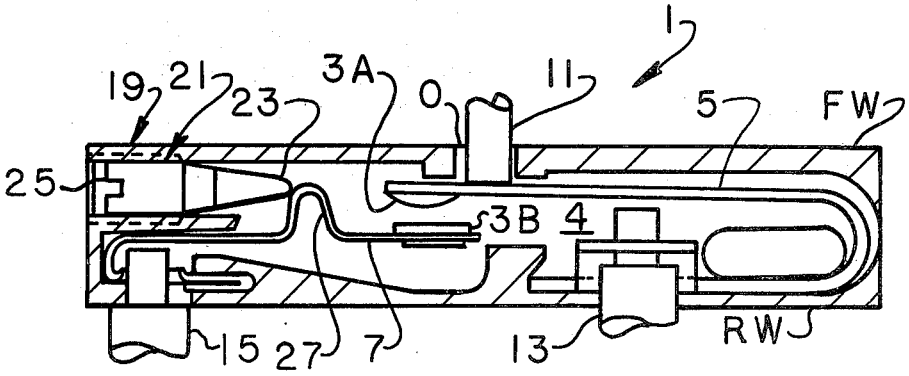

The improvement of the present invention is indicated generally 1 in FIGS. 2 and 3 and comprises a switch for sensing when the throttle valve moves towards its closed position. The switch includes a set of electrical contacts 3A and 3B respectively. The switch is enclosed in a cavity 4 formed behind the wall separating the d.c. motor from the set G of gears. A hairpin spring 5 has one end secured to rear wall RW forming the cavity, and electrical contact 3A is attached to the other end of the spring. Electrical contact 3B is attached to one end of a second spring 7. The other end of this spring also seats against rear wall RW of the cavity.

Drive gear DG has a hollow longitudinal central section and drive screw DS has a rearward extension 9 extending into this hollow portion of the drive gear. The forward end of a carrier pin 11 abuts the rear face of extension 9. Carrier pin 11 extends out through the back of the hollow central portion of drive gear DG and extends through an opening 0 in front wall FW of cavity 4. Hair pin spring 5 contacts the rear face of carrier pin 11 and exerts a preloading force on the carrier pin to, in effect, preload member M. The force exerted on carrier pin 11 by spring 5 is approximately one-half (0.5) pounds. This preloading force serves two purposes. First, it helps insure that contacts 3A and 3B are not closed inadvertently due to such factors as vibration and also, the preloading force helps compensate for tolerance on limit stacking to insure that the switch closes at a properly determined throttle valve closure point. It will be understood that when member M is contacted by throttle lever L during closure of the carburetor throttle valve, the force exerted on member M by the throttle lever pushes carrier pin 11 against spring 5 to push the spring inwardly and close the electrical contacts thereby actuating the switch. Thus, carrier pin 11 comprises means engaging the extendible and retractable member for moving one of the contacts into contact with the other when the throttle lever contacts the member as the throttle valve closes. Hairpin spring 5 comprises means biasing the engaging means against the member to preload the member.

As shown in FIG. 3, a pair of electrical leads 13 and 15, respectively, enter cavity 4 thorugh rear wall RW. Lead 13 is electrically connected to the fixed end of hairspring pin 5, while electrical lead 15 is electrically connected to the fixed end of spring 7. Thus, engagement or contact of contact 3A with contact 3B completes an electrical circuit via the switch.

To further compensate for limit stack tolerances which might affect the calibration of positioner P to sense throttle valve closing, the improvement of the present invention further includes means for adjusting electrical contacts 3A and 3B relative to each other. This adjustment means, designated 19, includes an adjustment screw 21 having a tapered inner end 23 and a slotted outer end 25 which is accessible for adjustment of the screw by a screw driver or similar adjustment tool. Spring 7 has a U-shaped segment 27 and tapered end 23 of screw 21 contacts segment 27. The position of contact 3B relative to contact 3A is adjusted by turning screw 21 so tapered end 23 thereof pushes against segment 27 of spring 7 with more or less force. As shown in FIG. 3, when screw 21 is inserted into cavity 4, it moves contact 3B away from contact 3A while if the screw is withdrawn from the cavity, contact 3B is allowed to come nearer contact 3A. In either event, the adjustment is made during calibration of positioner P so contacts 3A and 3B close when throttle lever L contacts the outer end of member M at a predetermined angle of throttle valve closure. Thus, a series of positioners P can each be independently calibrated to compensate for tolerance variations in each so each positioner in the group has a throttle closure sensing switch 1 which is actuated at the proper throttle valve closing position.

In view of the above, it will be seen that the several objects of the invention are achieved and other advantageous results obtained.

As various changes could be made in the above construction without departing from the scope of the invention, it is intended that all matter contained in the above description and shown in the accompanying drawing shall be interpreted as illustrative and not in a limting sense.

What is claimed is:

1. In apparatus for adjusting the position to which a carburetor throttle valve closes, the apparatus comprising a reversible d.c. motor having a rotatable shaft, an extendible and retractable member contacting and contacted by a throttle lever which moves the throttle valve, and a set of gears for translating rotary movement of the motor shaft in either direction into linear movement of the member in the appropriate direction, the improvement comprising switch means for sensing when the throttle valve moves towards it substantially closed position, the switch means including a set of electrical contacts each of which is mounted on the end of a spring with one of the springs having a U-shaped segment, means engaging the extendible and retractable member for moving one of the contacts into contact with the other when the throttle lever contacts the member as the throttle valve closes, means biasing the engaging means against the member to preload the member, and means for adjusting the position of the electrical contacts relative to each other.

2. The improvement of claim 1 wherein the adjusting means comprises a screw threaded into a wall of a housing in which the switch means is enclosed, the screw having a tapered inner end bearing against the U-shaped segment of the one spring so adjustment of the screw moves the spring, movement of the one spring moving the electrical contact on the end thereof relative to the electrical contact on the end of the other spring.

3. The improvement of claim 1 wherein the engaging means comprises a pin and the biased means comprises a spring bearing against one end of the pin.

4. The improvement of claim 3 wherein the last said spring is a hairpin spring having a fixed end and a free end with one of the electrical contacts being attached to the free end of the spring.

* * * * *